US012807443B2

(12) United States Patent
Kawamura et al.

(10) Patent No.: US 12,807,443 B2
(45) Date of Patent: Nov. 24, 2026

(54) SHEET ALIGNING DEVICE AND IMAGE FORMING SYSTEM

(71) Applicant: KYOCERA Document Solutions Inc., Osaka (JP)

(72) Inventors: Toshiki Kawamura, Osaka (JP); Mashio Takezawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 19/216,591

(22) Filed: May 22, 2025

(65) Prior Publication Data

US 2025/0367948 A1 Dec. 4, 2025

(30) Foreign Application Priority Data

Jun. 4, 2024 (JP) ..... 2024-090400

(51) Int. Cl.
*B65H 9/16* (2006.01)
*B65H 5/38* (2006.01)
*B65H 9/10* (2006.01)

(52) U.S. Cl.
CPC ..... *B65H 9/166* (2013.01); *B65H 5/38* (2013.01); *B65H 9/106* (2013.01); *B65H 2404/72* (2013.01); *B65H 2801/06* (2013.01)

(58) Field of Classification Search
CPC ..... B65H 9/103; B65H 9/105; B65H 9/106; B65H 9/16; B65H 9/163; B65H 9/166
See application file for complete search history.

(56) References Cited

U.S. PATENT DOCUMENTS 5,162,857 A * 11/1992 Higeta ..... G03G 15/234 271/251
6,273,418 B1 8/2001 Fujikura et al.
6,951,429 B2 10/2005 Aoyama
7,445,208 B2 11/2008 Onodera

FOREIGN PATENT DOCUMENTS

JP S58109344 A 6/1983
JP S6151445 A 3/1986

OTHER PUBLICATIONS

Extended European Search Report issued in EP 25175675.5-1014 by the European Patent Office on Oct. 20, 2025.

* cited by examiner

*Primary Examiner* — Jeremy R Severson
(74) *Attorney, Agent, or Firm* — Studebaker Brackett PLLC

(57) ABSTRACT

A sheet aligning device includes a conveying roller, a reference member, and an aligning roller. The conveying roller conveys a sheet in a predetermined conveyance direction along a conveyance path. The reference member defines one boundary of the conveyance path. By the aligning roller, the sheet conveyed by the conveying roller is abutted against the reference member. The reference member has a side surface on a side of the aligning roller. The side surface has a first side surface and a second side surface. The first side surface is along the boundary of the conveyance path. The second side surface is provided contiguous with the first side surface at least on one of an upstream and downstream sides of the first side surface in the conveyance direction, and is further separated from the conveyance path as it is farther from the first side surface.

3 Claims, 9 Drawing Sheets

SHEET ALIGNING DEVICE AND IMAGE FORMING SYSTEM

INCORPORATION BY REFERENCE

This application is based on and claims the benefit of priority from Japanese patent application No. 2024-090400 Jun. 4, 2024, which is incorporated by reference in its entirety.

BACKGROUND

The present disclosure relates to a sheet aligning device and an image forming system.

In an image forming apparatus, a sheet is conveyed along a conveyance path passing through an image forming part in which an image is formed on the sheet. When the sheet enters the image forming part in a posture inclined with respect to the conveyance direction, an image is obliquely formed on the sheet. Therefore, it is necessary to correct the inclination of the sheet before entering the image forming part. A registration roller is generally used as a means for correcting inclination of the sheet, but a configuration in which the sheet is abutted against a reference member provided on the lateral side of the conveyance path is also known.

In the above-described configuration, the sheet is abutted against the reference member by a roller for moving the sheet in a direction intersecting the conveyance direction, but when the sheet is inclined with respect to the conveyance direction, one end of one side of the four sides of the sheet, in which the one side faces the reference member, first is in contact with the reference member, and then the roller moves the sheet. As a result, the sheet buckles before the other end of one side is in contact with the reference member, and the inclination cannot be corrected.

SUMMARY

A sheet aligning device according to the present disclosure includes a conveying roller, a reference member, and an aligning roller. The conveying roller conveys a sheet in a predetermined conveyance direction along a conveyance path. The reference member defines one boundary of the conveyance path. By the aligning roller, the sheet conveyed by the conveying roller is abutted against the reference member. The reference member has a side surface on a side of the aligning roller. The side surface has a first side surface and a second side surface. The first side surface is along the boundary of the conveyance path. The second side surface is provided contiguous with the first side surface at least on one of an upstream and downstream sides of the first side surface in the conveyance direction, and is further separated from the conveyance path as it is farther from the first side surface.

An image forming system includes the sheet aligning device, and an image forming apparatus which forms an image on the sheet aligned by the sheet aligning device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the drawings, an image forming system 100 according to one embodiment of the present disclosure will be described.

Figure 1:
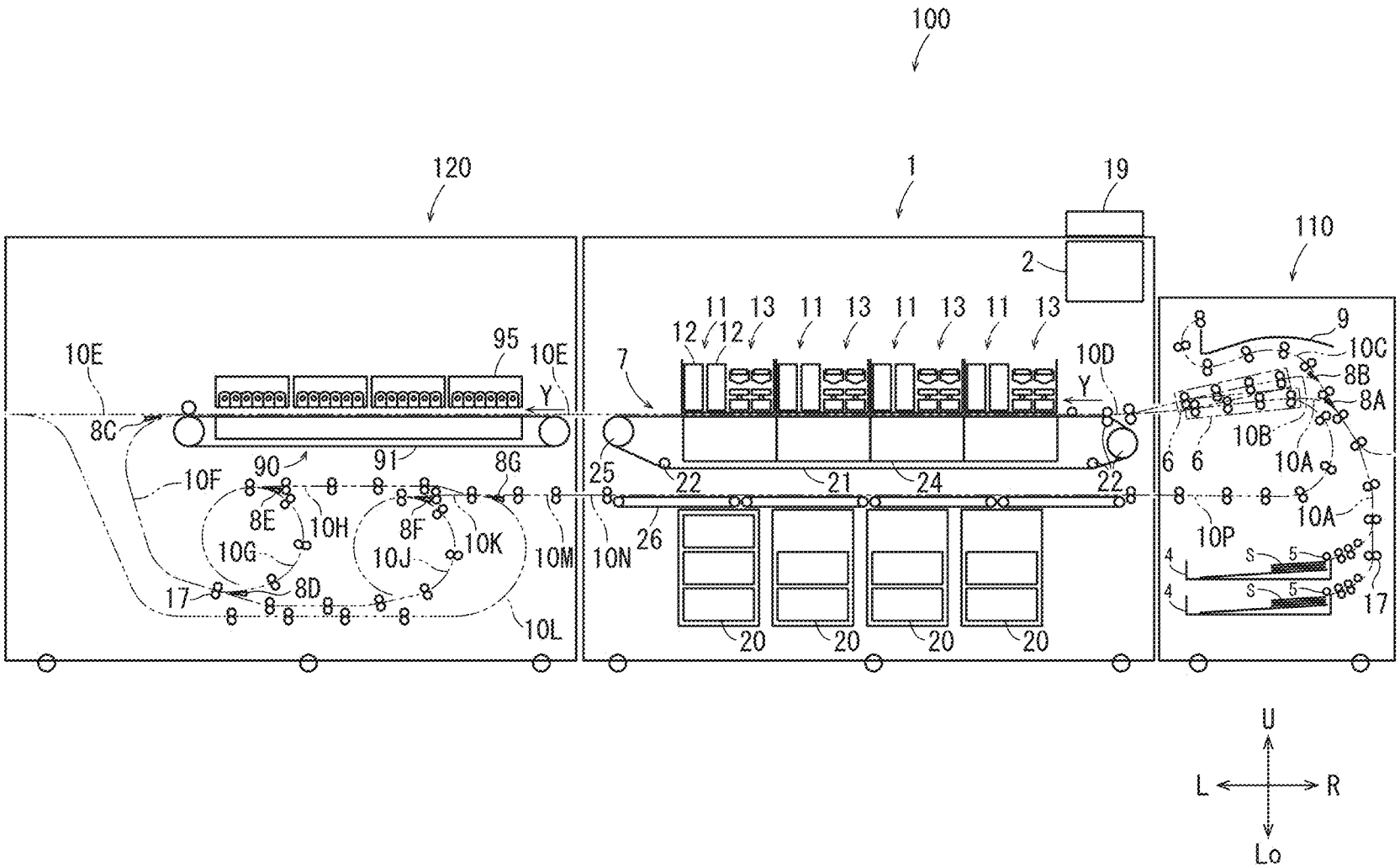
FIG. 1 is a front view schematically showing an internal structure of an image forming system according to one embodiment of the present disclosure.

FIG. 1 is a front view schematically showing an internal structure of the image forming system 100. Hereinafter, the front side of the paper plan on which FIG. 1 is drawn is defined as the front side of the image forming system 100, and the left-and-right direction will be described with reference to the direction in which the image forming system 100 is shown from the front side. In each figure, U, Lo, L, R, Fr, and Rr indicate the upper, lower, left, right, front, and rear, respectively.

The image forming system 100 includes a sheet feeding apparatus 110, an inkjet recording apparatus 1, and a drying apparatus 120. The sheet feeding apparatus 110 stores a sheet S, and feeds the sheet S to the inkjet recording apparatus 1. The inkjet recording apparatus 1 forms an image on the sheet S by an inkjet system. The drying apparatus 120 heats the sheet S conveyed from the inkjet recording apparatus 1 to dry the ink. A post-processing apparatus (not shown) for loading the discharged sheet S may be provided on the left side of the drying apparatus 120. The post-processing apparatus may have functions such as staple closing, folding, and drilling.

The sheet feeding apparatus 110 includes a sheet feeding cassette 4, a sheet feeding roller 5, a conveyance path 10A, a sheet aligning device 6, and a retreat tray 9. The sheet feeding cassette 4 stores the stacked sheets S. The sheet feeding roller 5 feeds the sheets S one by one from the sheet feeding cassette 4 to the conveyance path 10A. Two of the sheet aligning devices 6 having the same basic configuration are arranged above and below. The sheet aligning device 6 has a function of correcting the inclination of the sheet S with respect to the conveyance direction A and a function of correcting the displacement of the position of the sheet S in the width direction X crossing the conveyance direction A. The conveyance path 10A communicates with the lower sheet aligning device 6. A conveyance path 10B is branched from the conveyance path 10A and communicates with the upper sheet aligning device 6. A conveyance path 10C is branched from the conveyance path 10B and communicates with the retreat tray 9. The conveyance paths 10A, 10B and 10C are provided with conveyance rollers 17 for conveying the sheet S.

An opening/closing member 8A is provided at a branch point between the conveyance path 10A and the conveyance path 10B, which is turned around an axis to open one of the conveyance path 10A and the conveyance path 10B and to close the other. The sheet S is guided to the conveyance path 10A by opening the conveyance path 10A by the opening/closing member 8A, and the sheet S is guided to the conveyance path 10B by opening the conveyance path 10B by the opening/closing member 8B.

An opening/closing member 8B is provided at a branch point between the conveyance path 10B and the conveyance path 10C, which is turned around an axis to open one of the conveyance path 10B and the conveyance path 10C and to close the other. The sheet S is guided to the conveyance path 10B by opening the conveyance path 10B by the opening/closing member 8B, and the sheet S is guided to the conveyance path 10C by opening the conveyance path 10C by the opening/closing member 8B.

The inkjet recording apparatus 1 includes a conveying unit 7 which attracts and conveys the sheet S in the predetermined conveyance direction Y. Four head units which ejects the ink to form an image are provided above the conveying unit 7. The inkjet recording apparatus 1 includes a conveyance path 10D passing through a gap between the conveying unit 7 and the head units 11. The conveyance path 10A and the conveyance path 10B are merged with a conveyance path 10D.

The conveying unit 7 includes an endless conveying belt 21 and a suction part 24. The conveying belt 21 has a large number of air-holes (not shown), and is wound around a driving roller 25 and a driven roller 22. The upper surface of the suction part 24 has a large number of air-holes (not shown), and is in contact with the inner surface of the conveying belt 21. The suction part 24 sucks air through the air-holes of the conveying belt 21 and the air-hole of the suction part 24, thereby attracting the sheet S to the conveying belt 21. The driving roller 25 is driven in the counterclockwise direction by a drive unit (not shown) including reduction gear, whereby the conveying belt 21 travels in the counterclockwise direction, and the sheet S attracted to the conveying belt 21 is conveyed in the Y direction.

Each head unit 11 includes one or more inkjet heads 12. Ink containers 20 filled with the black, cyan, magenta and yellow inks are connected to the respective head units 11. The four head units 11 are arranged at intervals from each other, and a maintenance unit 13 for performing maintenance of the inkjet head 12 is arranged on the right side of each head unit 11.

The control part 2 (see FIG. 2) includes an arithmetic part and a storage part (not shown). The arithmetic part is, for example, a CPU (Central Processing Unit). The storage part includes a storage medium such as ROM (Read Only Memory), RAM (Random Access Memory), and EEPROM (Electrically Erasable Programmable Read Only Memory). The arithmetic part reads and executes the control program stored in the storage part to perform various processes. The control part 2 may be implemented by an integrated circuit that does not use software.

A display operation part 19 includes a display panel, a touch panel laminated on the display panel, and a keypad (not shown). The control part 2 displays a screen showing an operation menu, a status or the like of the inkjet recording apparatus 1 on the display panel, and controls each part of the inkjet recording apparatus 1 according to the operation detected by the touch panel and the keypad.

The drying apparatus 120 includes a conveying unit 90 and a heating unit 95. The conveying unit 90 attracts the sheet S to the conveyance belt 91 by the same principle as that of the conveying unit 7, and conveys the sheet S in the Y direction. The heating unit 95 is provided with a heat source such as an infrared heater to dry the ink on the sheet S.

The drying apparatus 120 includes a conveyance path 10E passing through a gap between the conveying unit 90 and the heating unit 95. The conveyance path 10D is connected to the conveyance path 10E. A conveyance path 10F is branched downward from the conveyance path 10E. The conveyance path 10F is branched into a conveyance path 10G and a conveyance path 10J. The conveyance path 10G and the conveyance path 10J are curved in an arc shape. A conveyance path 10H is branched rightward from the conveyance path 10G, and a conveyance path 10K is branched rightward from the conveyance path 10J. The conveyance path 10H and the conveyance path 10K are merged with a conveyance path 10M. A conveyance path 10L is branched downward from the conveyance path 10M, passes below the conveyance paths 10J, 10G, 10F, and is merged with the conveyance path 10E. The conveyance paths 10E, 10F, 10G, 10H, 10J, 10K, 10L and 10M are provided with conveyance rollers 17 for conveying the sheet S.

An opening/closing member 8C is provided at a branch point between the conveyance path 10E and the conveyance path 10F, which is turned around an axis to open one of the conveyance path 10E and the conveyance path 10F and to close the other. The sheet S is guided to the conveyance path 10E by opening the conveyance path 10E by the opening/closing member 8C, and the sheet S is guided to the conveyance path 10F by opening the conveyance path 10F by the opening/closing member 8C.

An opening/closing member 8D is provided at a branch point between the conveyance path 10G and the conveyance path 10K, which is turned around an axis to open one of the conveyance path 10G and the conveyance path 10K and to close the other. The sheet S is guided to the conveyance path 10G by opening the conveyance path 10G by the opening/closing member 8D, and the sheet S is guided to the conveyance path 10K by opening the conveyance path 10K by the opening/closing member 8C.

An opening/closing member 8E is provided at a branch point between the conveyance path 10G and the conveyance path 10H, which is turned around an axis to open one of the conveyance path 10G and the conveyance path 10H and to close the other. When the sheet S is inverted, the opening/closing member 8E opens the conveyance path 10G, and the conveyance roller 1 conveys the sheet S in the counterclockwise direction until the trailing end of the sheet S entering the conveyance path 10G exceeds the branch point, and then the opening/closing member 8E opens the conveyance path 10H, and the conveyance roller 17 conveys the sheet S in the clockwise direction.

An opening/closing member 8F is provided at a branch point between the conveyance path 10J and the conveyance path 10H, which is turned around an axis to open one of the conveyance path 10J and the conveyance path 10H and to close the other. When the sheet S is inverted, the opening/closing member 8E opens the conveyance path 10J, and the conveyance roller 17 conveys the sheet S in the counterclockwise direction until the trailing end of the sheet S entering the conveyance path 10J exceeds the branch point, and then the opening/closing member 8F opens the conveyance path 10K, and the conveyance roller 17 conveys the sheet S in the clockwise direction.

An opening/closing member 8F is provided at a branch point between the conveyance path 10J and the conveyance path 10M, which is turned around an axis to open one of the conveyance path 10L and the conveyance path 10K and to close the other. The sheet S is guided to the conveyance path 10L by opening the conveyance path 10L by the opening/closing member 8F, and the sheet S is guided to the conveyance path 10M by opening the conveyance path 10M by the opening/closing member 8F.

The inkjet recording apparatus 1 includes a conveyance path 10N connected to the conveyance path 10M, and the sheet feeding apparatus 110 includes a conveyance path 10P extending from the conveyance path 10N to the lower sheet aligning device 6. The conveyance path 10N includes, for example, an electrostatic attraction type conveying belt 26 for attracting and conveying the sheet S by static electricity.

The basic operation of the image forming system 100 is as follows. When an image forming job is input to the inkjet recording apparatus 1 from the display operation part 19 or an external computer, the sheet feeding roller 5 feeds the sheet S one by one from the sheet feeding cassette 4 to the conveyance path 10A. Each time the sheet S is fed out, the opening/closing member 8A alternately opens the conveyance path 10A and the conveyance path 10B, and the lower and upper sheet aligning devices 6 alternately perform sheet aligning processing. When the sheet aligning device 6 feeds the sheet S to the conveying unit 7 at a predetermined timing, the conveying unit 7 attracts the sheet S to the conveying belt 21, and conveys the sheet S in the Y direction. When the control part 2 supplies raster type image data to the head units 11 in synchronization with the conveyance of the sheet S, the ink is ejected from the head unit 11 to form an image on the sheet S. The sheet S on which the image is formed is conveyed to the drying apparatus 120.

In the drying apparatus 120, the ink on the sheet S conveyed along the conveyance path 10E is dried. In the case of an image forming job for one-sided printing of only one sheet, the sheet S is guided to the conveyance path 10E and then conveyed to the post-processing apparatus (not shown) connected to the left side of the drying apparatus 120. On the other hand, in the case of the image forming job for one-sided printing of a plurality of the sheets, the sheet S is guided to the conveyance path 10F, and after being inverted by alternately using the conveyance path 10G and the conveyance path 10J, the sheet S is conveyed to the post-processing apparatus via the conveyance path 10L.

On the other hand, in the case of the image forming job of double-sided printing, the sheet S is inverted by alternately using the conveyance path 10G and the conveyance path 10J, and then conveyed to the lower sheet aligning device 6 via the conveyance paths 10M, 10N, and 10P, and an image is formed on the rear surface by the inkjet recording apparatus 1. After that, the ink is dried by the drying apparatus 120, and after being inverted by alternately using the conveyance path 10G and the conveyance path 10J, the sheet is conveyed to the post-processing apparatus via the conveyance path 10L.

Figure 2:
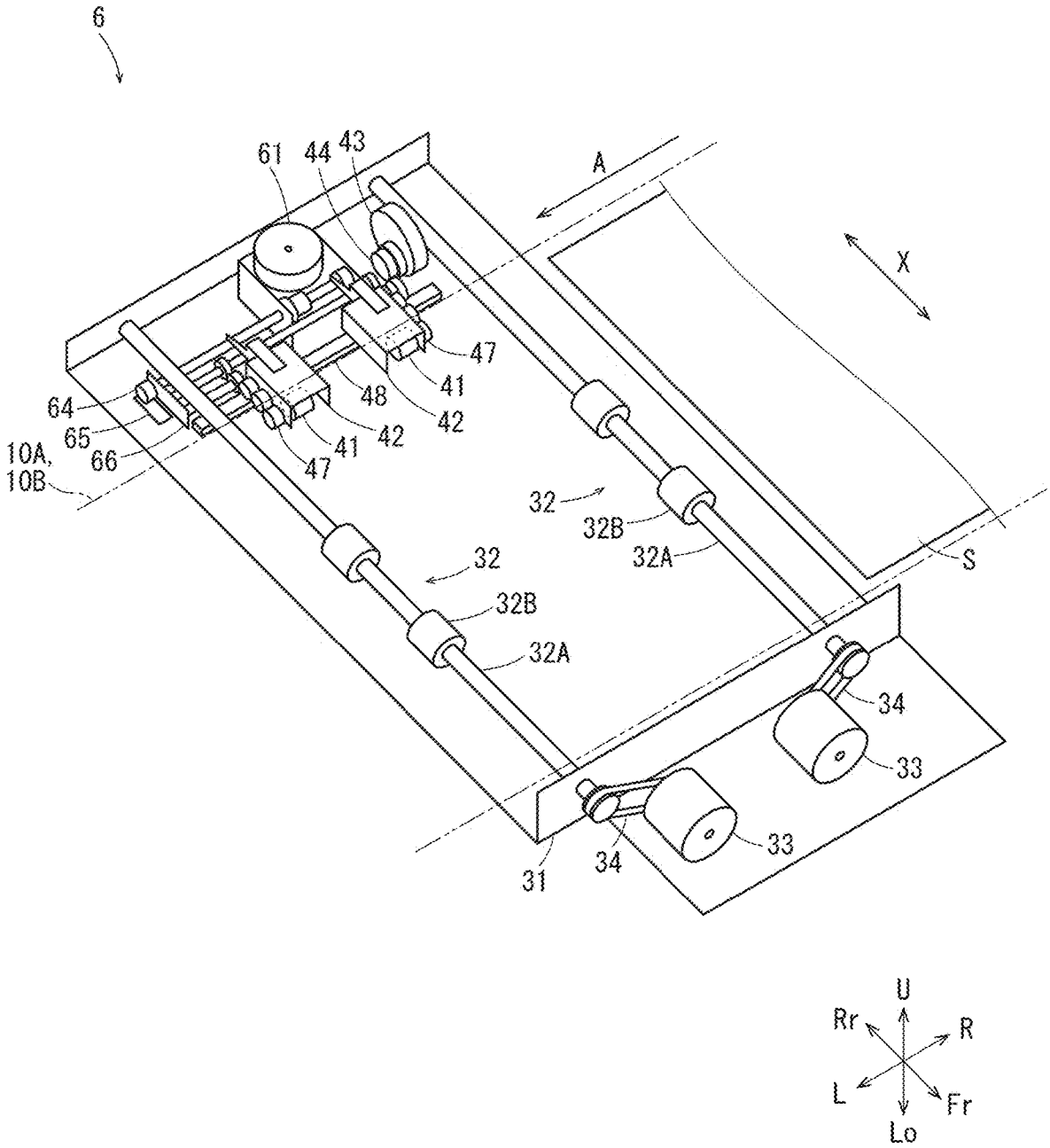
FIG. 2 is a perspective view showing a sheet aligning device according to the embodiment of the present disclosure.
Figure 3:
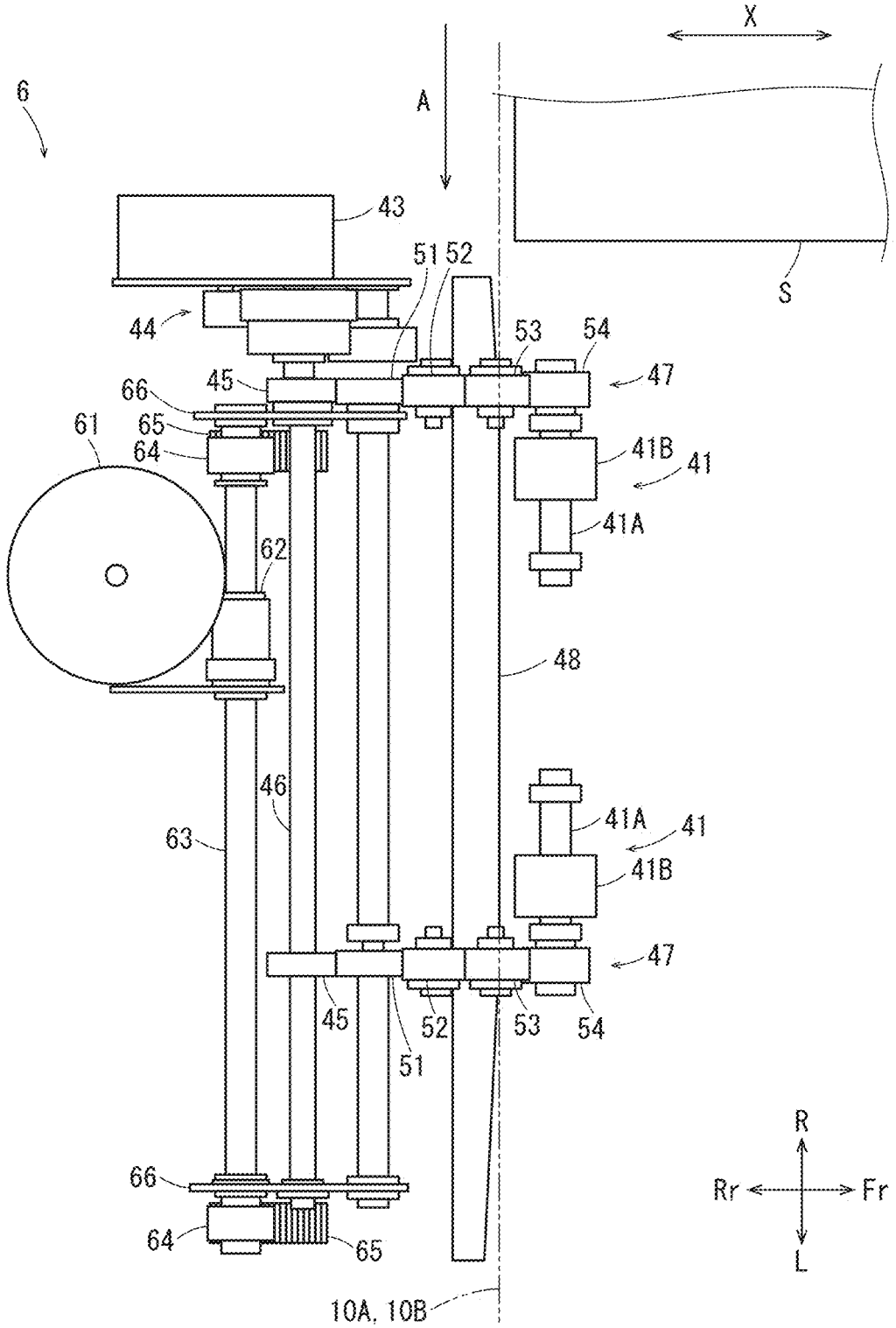
FIG. 3 is a plan view showing a main part of the sheet aligning device according to the embodiment of the present disclosure.
Figure 4:
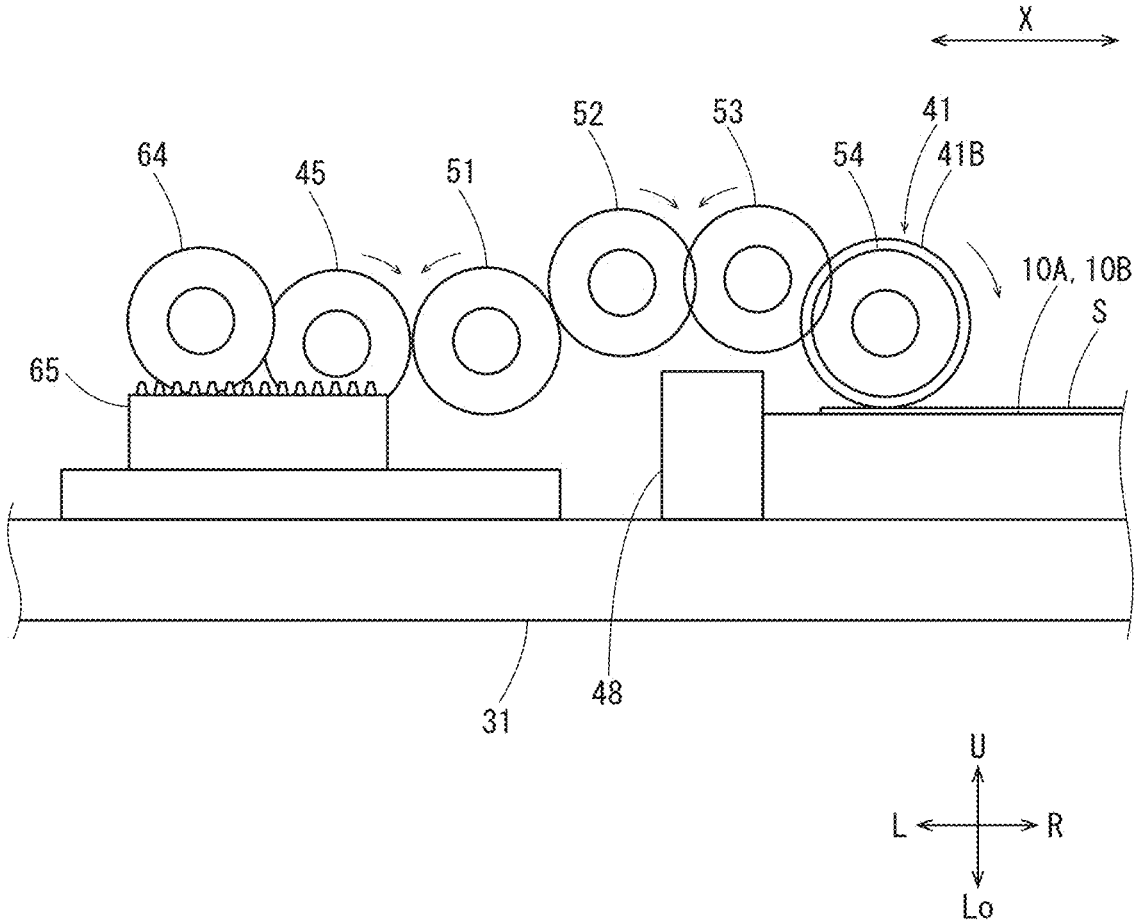
FIG. 4 is a schematic view showing the main part of the sheet aligning device according to the embodiment of the present disclosure.

[Sheet Aligning Device] FIG. 2 is a perspective view showing the sheet aligning device 6. FIG. 3 is a plan view showing the main part of the sheet aligning device 6. FIG. 4 is a schematic view showing the main part of the sheet aligning device 6. The sheet aligning device 6 is disposed in a posture in which the conveyance direction A (see FIG. 2 and FIG. 3) of the sheet S is inclined with respect to the horizontal (see FIG. 1), but for convenience of explanation, the conveyance direction A is assumed to be horizontal.

The sheet aligning device 6 includes a frame body 31, a conveying roller 32, an aligning roller 41, and a reference member 48. The frame body 31 is formed in a generally rectangular shape whose front-and-rear direction is longer than the left-and-right direction. The frame body 31 supports various components shown below. The conveying roller 32 has a shaft 32A and a plurality of roller bodies 32B. The conveying roller 32 is provided at two positions of a right end portion and a left end portion of the frame body 31 with the axial direction being along the front-and-rear direction. The conveying roller 32 is driven by a motor 33 via a timing belt 34.

The reference member 48 is disposed on the rear side of the sheet S conveyed by the right conveying roller 32. The reference member 48 is a generally rectangular parallelepiped member whose longitudinal direction is along the left-and-right direction. The aligning roller 41 is provided at two positions between the right and left conveying rollers 32 and on the front side of the reference member 48.

Next, the configuration of the right aligning roller 41 and its periphery will be described. The aligning roller 41 has a shaft 41A and a roller body 41B. The aligning roller 41 is supported by a box-shaped holder 42 with the axial direction being along the left-and-right direction. A driving force of a motor 43 is transmitted to the aligning roller 41 through a gear train 44, a drive gear 45, and a gear train 47 in order. The gear train 47 is provided on the right side surface of the holder 42, and has gears 51, 52, 53 and 54 in order from the rear side. The gear 54 is attached to the right end of the shaft 41A of the aligning roller 41.

The left aligning roller 41 is also provided with the holder 42, the drive gear 45, and the gear train 47 in the same manner as that on the right side. The gear train 47 of the left aligning roller 41 is provided on the left side surface of the holder 42. Since the right and left drive gears 45 are attached to a common shaft 46, the right and left aligning rollers 41 are driven synchronously.

The gear 51 and the drive gear 45 are attached to a connection member 66. A pinion 64 is attached to the connection member 66. The right and left pinions 64 are attached to a common shaft 63, and the shaft 63 is driven by a motor 61 through a worm gear 62. The pinion 64 is meshed with a rack 65 fixed to the frame body 31. By rotation of the pinion 64, the aligning roller 41 is moved rearward and forward through the connection member 66 and the holder 42. With this configuration, the position of the aligning roller 41 in the front-and-rear direction can be adjusted.

Figure 5:
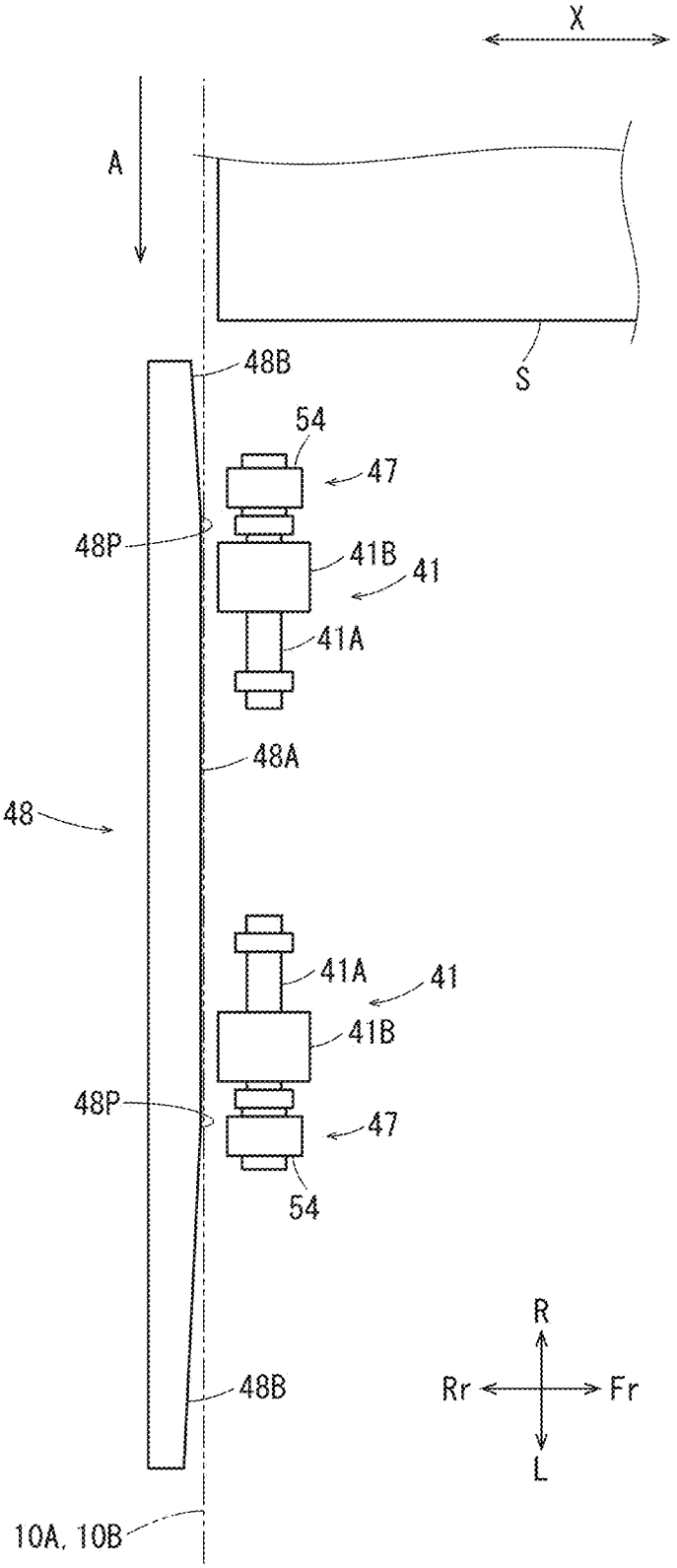
FIG. 5 is a plan view showing a reference member according to the embodiment of the present disclosure.

FIG. 5 is a plan view showing the reference member 48. The side surface of the reference member 48 on the side of the aligning roller 41 has a first side surface 48A and a second side surface 48B. The first side surface 48A defines one boundary of the conveyance paths 10A, 10B (in this example, the rear boundary of the conveyance paths 10A, 10B). The second side surface 48B is provided contiguous with the first side surface 48A at least on one of the upstream and downstream sides of the first side surface 48A in the conveyance direction A. The second side surface 48B is further separated from the conveyance paths 10A, 10B as it is farther from the first side surface 48A. A boundary 48P between the first side surface 48A and the second side surface 48B is an obtuse angle. In this embodiment, the second side surface 48B is provided on both the upstream and downstream sides of the first side surface 48A in the conveyance direction A, but the second side surface 48B may be provided either on the upstream or downstream side of the first side surface 48A.

Figure 6:
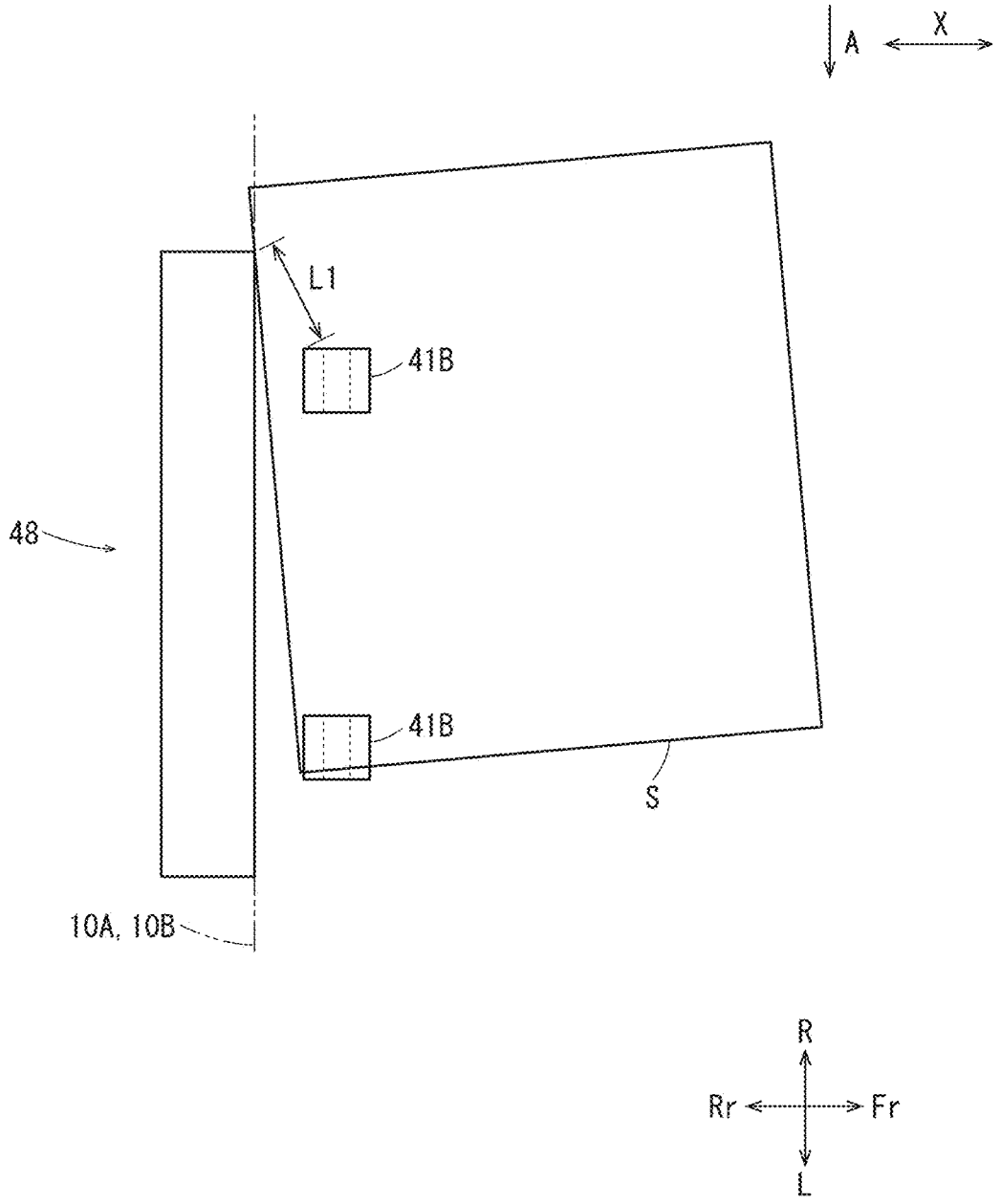
FIG. 6 prior art
FIG. 6 is a plan view showing an operation of a conventional sheet aligning device.

FIG. 6 is a plan view showing an operation of a conventional sheet aligning device 6. The reference member 48 is formed in a rectangular shape. When the sheet S is conveyed in the conveyance direction A with a posture inclined in counterclockwise direction, the sheet S is conveyed rearward in a state where one side of the sheet S is in contact with the upstream corner of the reference member 48 in the conveyance direction A, and the sheet S rotates in a clockwise direction around the contact point between the sheet S and the reference member 48. In this case, since a distance L1 between the contact point and the aligning roller 41 is large, the sheet S has more freedom to be deformed, and the sheet S is more likely to buckle.

Figure 7:
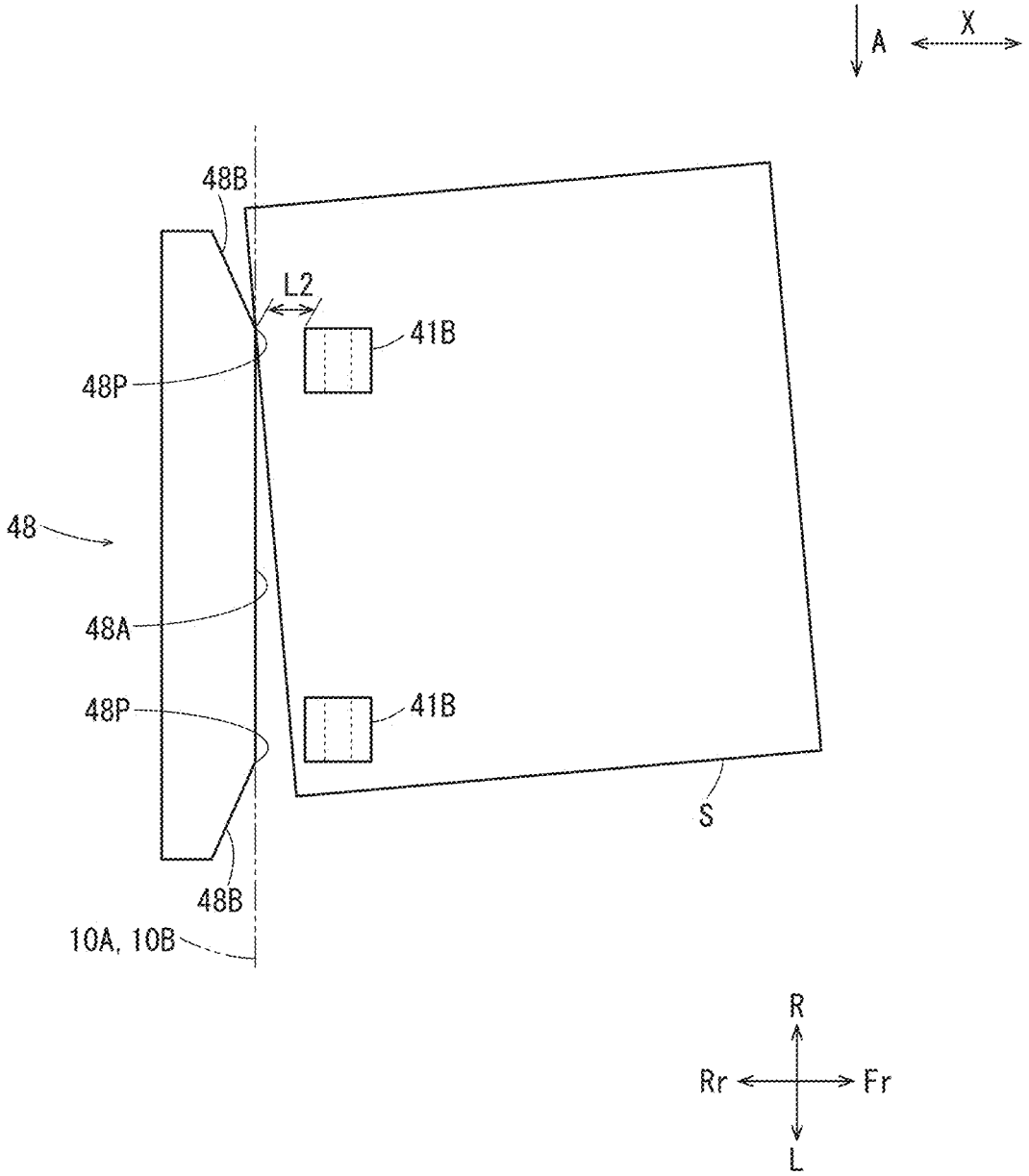
FIG. 7 is a plan view showing an operation of the sheet aligning device according to the embodiment of the present disclosure.

FIG. 7 shows a plan view showing an operation of the sheet aligning device 6 according to the present embodiment. The reference member 48 has the first side surface 48A and the second side surface 48B. When the sheet S is conveyed in the conveyance direction A with a posture inclined in a counterclockwise direction, the sheet S is conveyed rearward in a state where one side of the sheet S is in contact with the upstream boundary 48P of the reference member 48 in the conveyance direction A, and the sheet S rotates in a clockwise direction around the contact point between the sheet S and the reference member 48. In this case, since a distance L2 between the contact point and the aligning roller 41 is shorter than the distance L1, the sheet S has less freedom to be deformed, and the sheet S is less likely to buckle.

Figure 8:
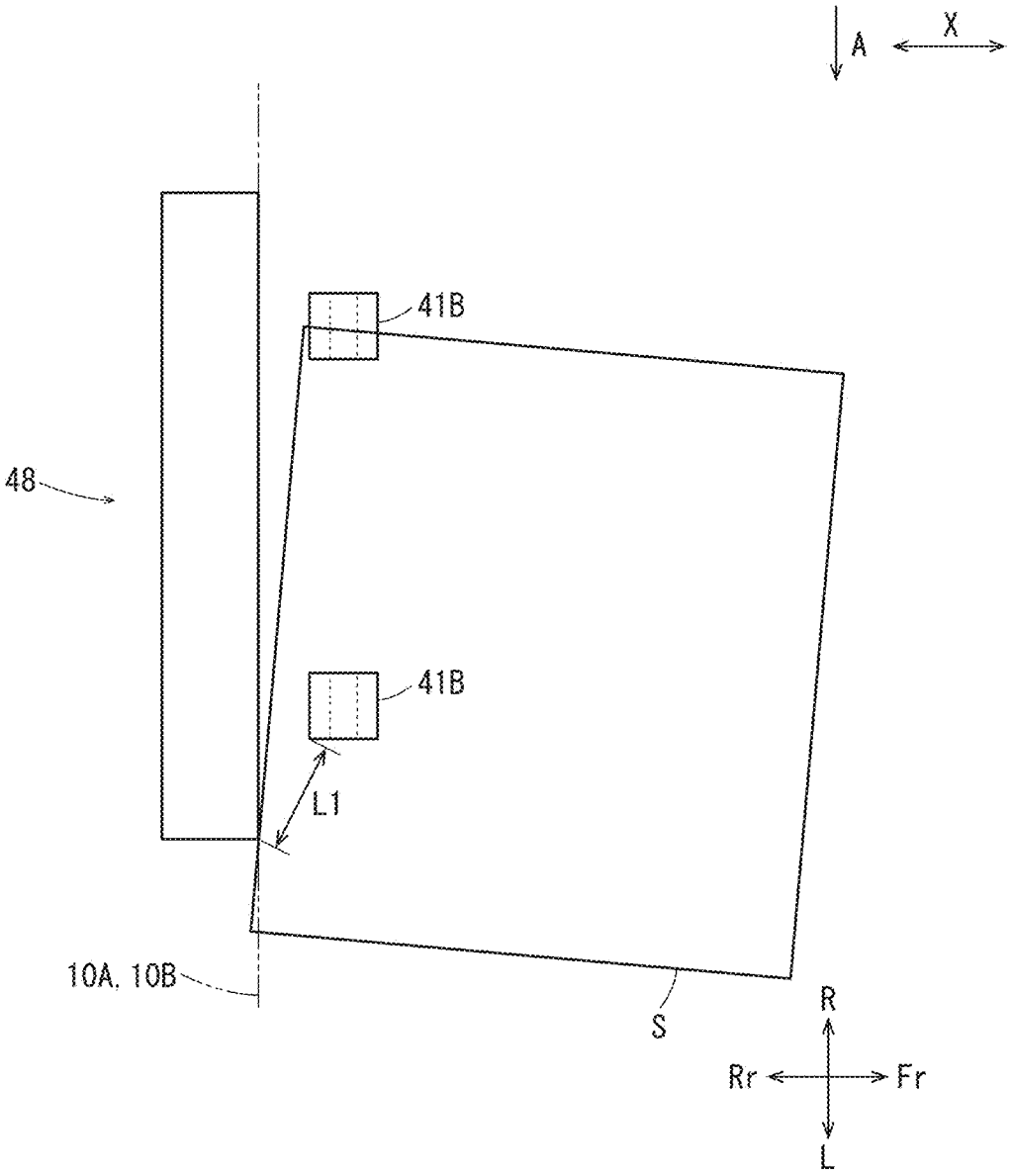
FIG. 8 prior art
FIG. 8 is a plan view showing the operation of the conventional sheet aligning device.

FIG. 8 is a plan view showing the operation of the conventional sheet aligning device 6. The reference member 48 is formed in a rectangular shape. When the sheet S is conveyed in the conveyance direction A with a posture inclined in a clockwise direction, the sheet S is conveyed rearward in a state where one side of the sheet S is in contact with the downstream corner of the reference member 48 in the conveyance direction A, and the sheet S rotates in a counterclockwise direction around the contact point between the sheet S and the reference member 48. In this case, since a distance L1 between the contact point and the aligning roller 41 is large, the sheet S has more freedom to be deformed, and the sheet S is more likely to buckle.

Figure 9:
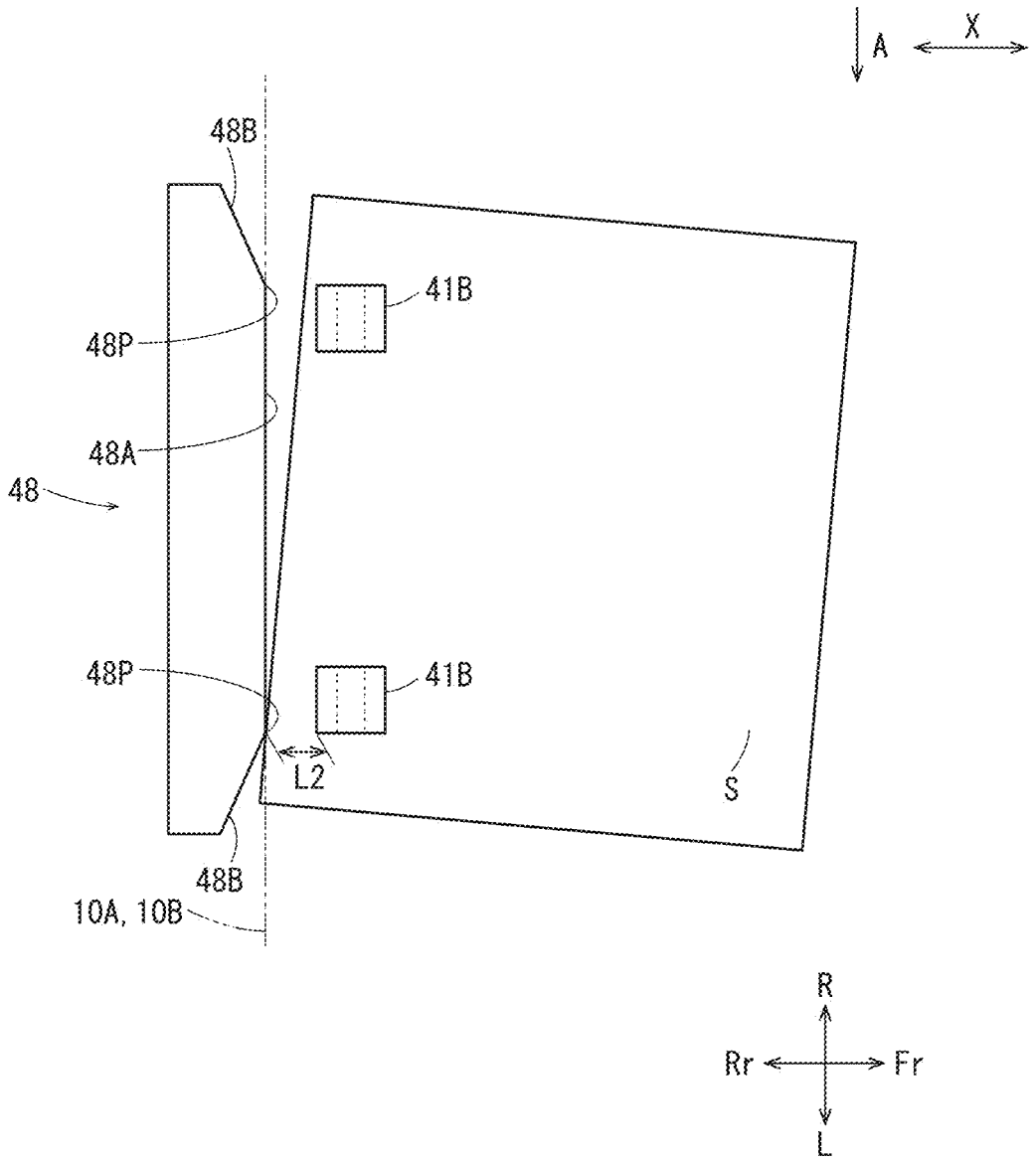
FIG. 9 is a plan view showing the operation of the sheet aligning device according to the embodiment of the present disclosure.

FIG. 9 shows a plan view showing the operation of the sheet aligning device 6 according to the present embodiment. The reference member 48 has the first side surface 48A and the second side surface 48B. When the sheet S is conveyed in the conveyance direction A with a posture inclined in a clockwise direction, the sheet S is conveyed rearward in a state where one side of the sheet S is in contact with the downstream boundary 48P of the reference member 48 in the conveyance direction A, and the sheet S rotates in a counterclockwise direction around the contact point between the sheet S and the reference member 48. In this case, since a distance L2 between the contact point and the aligning roller 41 is shorter than the distance L1, the sheet S has less freedom to be deformed, and the sheet S is less likely to buckle.

The sheet aligning device 6 according to this embodiment described above includes; the conveying roller 32 which conveys the sheet S in the predetermined conveyance direction A along the conveyance path 10A; the reference member 48 which defines one boundary of the conveyance path 10A; and the aligning roller 41 by which the sheet S conveyed by the conveying roller 32 is abutted against the reference member 48. The reference member 48 has the side surface on the side of the aligning roller 41, and the side surface has the first side surface 48A and the second side surface 48B. The first side surface 48A is along the boundary of the conveyance path 10A. The second side surface 48B is provided contiguous with the first side surface 48A at least on one of the upstream and downstream sides of the first side surface 48A in the conveyance direction A. The second side surface 48B is further separated from the conveyance paths 10A, 10B as it is farther from the first side surface 48A. According to this embodiment, one side of the sheet S can be abutted against the reference member 48 provided on the lateral side of the conveyance path 10A without buckling the sheet S.

According to the sheet aligning device according to this embodiment, the aligning roller 41 is closer to the boundary 48P between the first side surface 48A and the second side surface 48B than to the end portion of the reference member 48 in the conveyance direction A. According to this embodiment, the distance L2 between the contact point of the sheet S and the reference member 48 and the aligning roller 41 is shorter, which reduces the degree of freedom of the sheet S so that the sheet S is hardly buckled.

According to the sheet aligning device according to this embodiment, the aligning roller 41 is provided at two positions in the conveyance direction A. According to this embodiment, it is easier for the sheet S to be aligned with the reference member 48 than when there is only one aligning roller 41.

The image forming system 100 according to this embodiment includes the sheet aligning device 6 and the image forming device (inkjet recording device 1) that forms an image on a sheet S aligned by the sheet aligning device 6. According to this embodiment, the inclination and misalignment of image can be suppressed.

The above embodiment may be modified as follows.

In the above embodiment, an example in which the boundary 48P between the first side surface 48A and the second side surface e 48B forms an obtuse angle is shown, but the boundary 48P may be curved in an arc shape. According to this configuration, deformation of the portion of the sheet S abutted against the boundary 48P can be suppressed.

In the above embodiment, the image forming apparatus is the inkjet recording apparatus 1, but the image forming apparatus may be an apparatus for forming an image by a system other than the inkjet system (for example, electrophotographic system).

The invention claimed is:

1. A sheet aligning device comprising:

a conveying roller which conveys a sheet in a predetermined conveyance direction along a conveyance path;

a reference member which defines one boundary of the conveyance path; and an aligning roller by which the sheet conveyed by the conveying roller is conveyed in a direction perpendicular to the conveyance direction and abutted against the reference member, wherein the reference member has a side surface on a side of the aligning roller, the side surface has:

a first side surface which is along the boundary of the conveyance path, and a second side surface which is provided contiguous with the first side surface at least on one of an upstream and downstream sides of the first side surface in the conveyance direction, and is further separated from the conveyance path as it is farther from the first side surface, and the aligning roller is arranged so as to abut the sheet against a boundary portion between the first side surface and the second side surface and to rotate the sheet around a contact point between the sheet and the boundary portion.

2. The sheet aligning device according to claim 1, wherein the aligning roller is provided at two positions in the conveyance direction.

3. An image forming system comprising:

the sheet aligning device according to claim 1, and an image forming device which forms an image on a sheet S aligned by the sheet aligning device.

* * * * *